US005212955A

United States Patent [19]

Hogan

[11] Patent Number: 5,212,955

[45] Date of Patent: May 25, 1993

[54] HALF CRESCENT SHAPED ICE PIECE MAKER

[75] Inventor: Thomas H. Hogan, Anniston, Ala.

[73] Assignee: Mid South Industries, Inc., Rainbow City, Ala.

[21] Appl. No.: 926,197

[22] Filed: Aug. 7, 1992

[51] Int. Cl.[5] ..... F25C 5/08

[52] U.S. Cl. ..... 62/73; 62/353

[58] Field of Search ..... 62/71, 73, 135, 351, 62/353

[56] References Cited

U.S. PATENT DOCUMENTS

| | | | |
|---|---|---|---|
| 4,896,513 | 1/1990 | Troscinski | 62/353 X |
| 4,923,494 | 5/1990 | Karlovits | 62/353 X |
| 5,056,321 | 10/1991 | Patrick | 62/351 X |
| 5,056,322 | 10/1991 | Patrick | 62/351 X |

*Primary Examiner*—William E. Tapolcai

[57] ABSTRACT

An ice piece maker has a long tray (100) with an arcuately shaped inner surface divided into full crescent shaped cavities (122) arranged sideby-side along the tray length. A bidirectional rotatable shaft (106) is positioned with its axis coincident with the axis of the inner surface of the tray. Leading and lagging rows of ejector elements (114), (116) are in separate planes with said leading ejector elements (114) extending downwardly into the center of the cavities, herein defined as the 0° position of rotation, and with first ends of the leading ejector elements (114) attached to the shaft and being of a length to leave a space between its second ends and the tray bottom so that an ice bridge (152) can form between the leading and lagging ice pieces. A control controls the shaft rotation to a clockwise direction for X° which carries the leading ejector elements 114 past graduated height stripper elements (104) to distribute impact and strip the ice pieces from the leading ejector elements and then reverse to a counterclockwise direction the rotation of the shaft for Y°, where Y°>X°. The control then begins water flow into the cavities and continues to rotate to the dead 0° position where rotation stops and freezing begins. The clockwise rotation of the shaft begins again for X° to begin the cycle for making a new batch of half crescent shaped ice pieces (130) and (132).

18 Claims, 9 Drawing Sheets

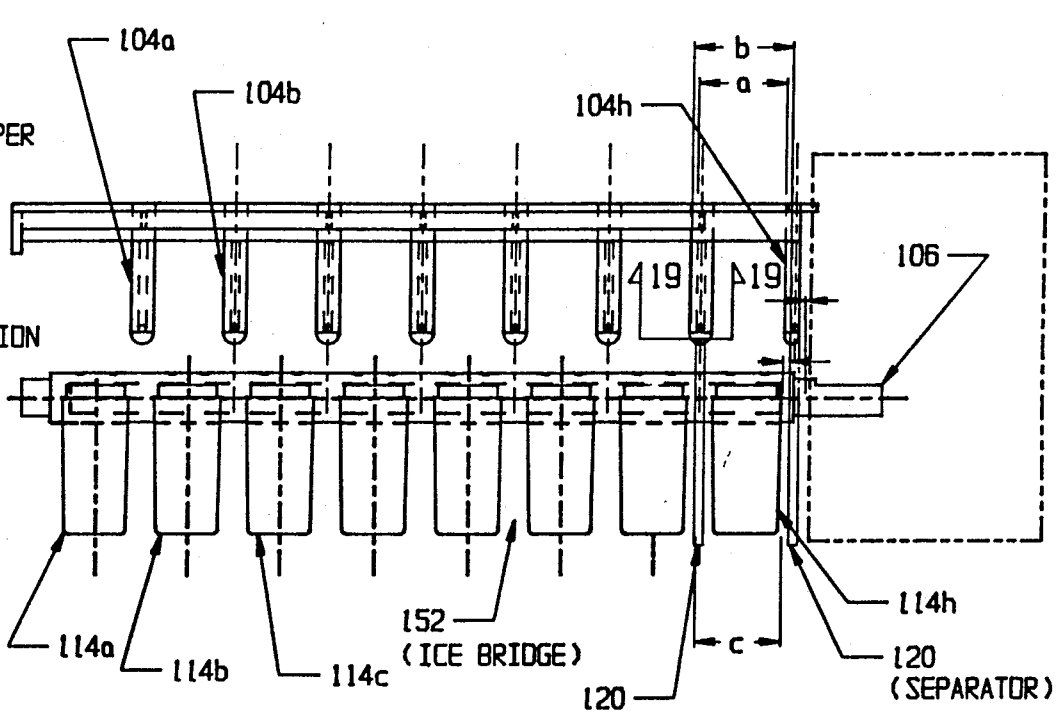
Fig. 25
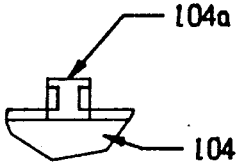
Fig. 28
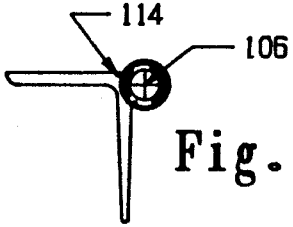
Fig. 26
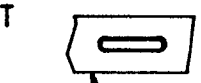
Fig. 27
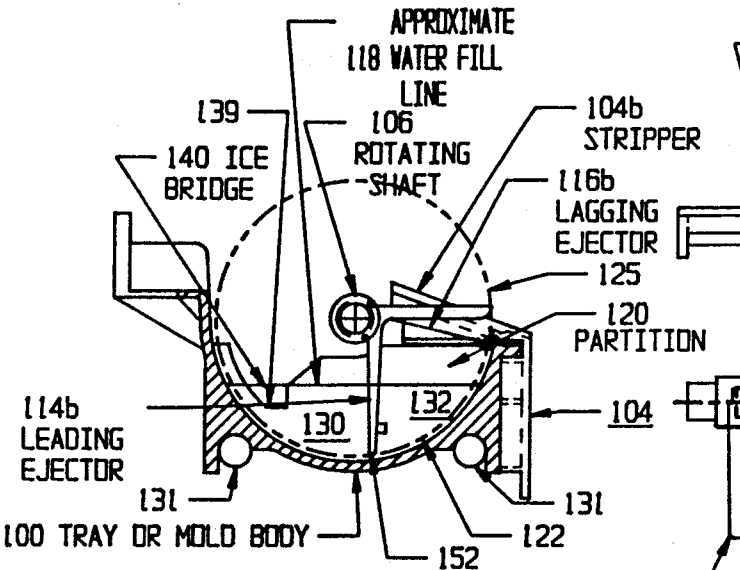
FIG. 24
Fig. 25a
LEGEND
a = DISTANCE BETWEEN EDGES OF ADJACENT SEPARATORS
b = WIDTH OF ICE PIECE
c = WIDTH OF EJECTOR ELEMENT
x = 0.060"
y = 0.120"
a - c = 0.120" = 2x
b - c = 0.240" = 2y

HALF CRESCENT SHAPED ICE PIECE MAKER

BACKGROUND OF THE INVENTION

This invention relates generally to ice piece makers for refrigerators and the like and more particularly to ice piece maker that make half crescent shaped ice pieces, and the method for making such half crescent shaped pieces.

Perhaps the most prevalent form of ice piece makers currently employed in home refrigerators and freezers make full crescent shaped ice pieces with crescent shaped parallel sides and a rectangularly shaped cross sectional profile viewed in a plane normal to the parallel sides, and further having a flat top surface.

The full crescent shaped ice pieces are easily formed and removed from ice piece makers and required simpler and less expensive ice piece making mechanisms than do makers of ice pieces of different configuration—i.e. cubes, cylinders, etc. Because of this feature, the full crescent shaped is preferred by most manufactures of domestic ice pieces makers. It remains, however, that, although adequate for many applications for ice pieces, the full crescent shaped presents difficulties in use in the home not only when used for cooling beverages in beverage glasses but also in the storage, removal and handling of the ice pieces in preparation of beverages, and other uses for ice pieces.

To overcome the above listed problems of full crescent shaped ice pieces ice makers which make half crescent shaped ice pieces have been developed such as shown and described in U.S. Pat. No. 4,863,153 issued Jan. 30, 1990 to Trocinski and entitled "Making Ice In a Refrigerator" and in U.S. Pat. No. 4,923,494 issued May 8, 1990 to Karlovitz and entitled "Making Ice In a Refrigerator."

Moving half or full crescent shaped ice pieces out of the freezing tray enhances the risk, with most prior art devices, of an ice piece accidentally falling back into the tray before it is ejected from the tray, thereby increasing the risk of faulty operation of the ice maker even to the point of stalling the rotation of the shaft.

One of the problems presented by prior art ice piece makers, and particular half crescent ice piece makers, is due to the half crescent ice pieces becoming solidly frozen to the ejector element (the primary ejector element) which lies between the leading and lagging half crescent ice pieces. This ice bond between the leading and lagging half crescent ice pieces is sometimes sufficiently strong to resist being broken loose from the primary ejector elements when the leading half crescent ice piece impacts the ice piece stripper elements with the result that the rotating shaft will stall and must be freed by human help.

In half crescent shaped ice pieces there is another ice bond, identified herein as an ice bridge, which exists around the primary ejector elements and connects the leading half crescent ice piece to the lagging half crescent ice piece of each full crescent shaped ice piece. The above-described ice bridge must also be broken when the leading half crescent ice piece impacts the ice stripper elements in order to separate the leading half crescent ice piece from the lagging half ice piece of each full crescent ice piece.

It would mark a definite improvement in the art to provide an improved half crescent ice piece maker which efficiently and with a minimum of force ejects the leading and lagging rows of half crescent shaped ice pieces from the freezing tray as quickly as possible to minimize the dripping of water into the freezing tray, to minimize the risk of a leading half crescent ice piece from accidentally dropping into the freezing tray, and most importantly to virtually ensure the breaking apart of the leading and lagging rows of half crescent shaped ice pieces before the ejection thereof from the freezing tray occurs.

OBJECTS AND BRIEF STATEMENT OF THE INVENTION

A primary object of the present invention is to more efficiently and with greater reliability make half crescent shaped ice pieces than is possible with the known prior art while maintaining the relative mechanical simplicity and other advantages of the prior half crescent ice piece makers.

Still another object of the invention is to provide a half piece ice maker in which the half crescent ice pieces will be more easily released from the ejector elements to which they are initially frozen and which will therefore be delivered with greater regularity than heretofore known to a collection bin from whence the homeowner can easily retrieve them.

In accordance with a preferred form of the invention there is provided a half crescent ice piece maker comprising an elongated tray having a arcuately shaped inner surface extending along the length of the tray about a radial line axis and divided into a plurality of full crescent shaped cavities arranged side-by-side along the length of said tray. A controllably bi-directional rotatable shaft assembly have a axis of rotation coincident with said radial line axis, comprises a leading and lagging rows of ejector elements lying in separate planes with a first end of each ejector element being attached to the shaft near or to the axis of said shaft and with the second ends of the leading ejector elements extending downwardly into the center of the cavities at the herein defined zero degrees of rotation position and being of a length to leave a spacing between the second end of the leading ejector elements and the bottom of the cavity in which an ice bridge can form between the leading and lagging ice pieces. A control means for controlling the direction of rotation of the shaft assembly in a first direction from the zero degrees rotation position for X angular degrees to pass the stripper elements which strip the leading and lagging crescent shaped ice pieces from the ejector elements and to then reverse the direction of rotation of the shaft assembly (including the ejector elements) for Y degrees of rotation, where $X^\circ > Y^\circ$, and with the control means responsive to the end of the Y degrees of reverse rotation to initiate a predetermined amount of water flow into the cavities in preparation for forming a new batch of half crescent shaped ice pieces but which continues to rotate in the reverse direction to said zero degrees rotation position of the leading ejector elements, and further with the control mean responsive to the leading ejector elements being in the zero degrees rotation position to allow the leading ejector elements to remain there until the water in the cavities freeze, and with the control means further responsive to the freezing of the water in the cavities to begin the rotation of the shaft in the first direction to initiate the production of a new batch of half crescent shaped ice pieces. A non-rotatable ice stripper assembly is positioned in the path of the ice pieces being rotated by the ejector assembly to stop the rotation of only the ice pieces and to bend back the row of leading ejector elements if they are formed of a flexible, spring-like material to create a potential force therein of a magnitude which will break the ice bridge between the leading and lagging half crescent ice pieces of the full crescent shaped ice pieces and enable the leading flexible, spring-like ejector elements to then spring forward and eject the leading row of half crescent ice pieces from the freezing tray. A second row of ejector elements is provided for ejecting the lagging row of ice pieces from the freezer tray.

A primary feature of the invention lies in the use of a reversible motor which can rotate the rotatable shaft either clockwise or counterclockwise under the control of a control means which responds to the angular position of a reversible cam, also driven by the reversible motor in synchronism with the motor to first control the amount of clockwise rotation of said shaft to initially rotate the leading and lagging ice pieces past the stripper elements a predetermined angular distance X° to break the leading and lagging ice pieces loose from each other, and then from the ejector elements, and next to reverse the rotation of the shaft to a counterclockwise direction a predetermined angular distance Y° to initiate water flow into said cavities, and finally to continue rotating the shaft assembly in a counterclockwise direction until the leading ejector element reaches its dead zero degrees position when the water is frozen into crescent shaped ice pieces and the control means directs the shaft to rotate said shaft a predetermined amount X° in a clockwise direction to begin a new cycle of ice piece making.

Another related feature of the invention is the us of the counterclockwise rotation of the leading ejector element after it has rotated past the stripper elements in its clockwise period of rotation when the ice pieces are stripped from the leading ejector elements by the stripper elements to lift up any lingering ice pieces that might have slipped off the stripper elements and fallen into the tray and allow them t slide off the rising leading ejector elements and out of the tray.

Yet another feature of the invention is the use of a reversible motor whose clockwise rotation is stopped when the clockwise rotating ejector element impacts against a stop element. The reversible motor contains control means which functions to cause the motor to reverse its direction of rotation when stopped and then to rotate in the opposite direction (counterclockwise). In the instant invention the motor and the leading ejector element initially are rotating in a clockwise direction when the leading ejector elements impact against the stop elements after the leading ejector elements have passed the stripper elements and the ice pieces stripped from such leading ejector elements, and the stalled motor then reverses its direction of rotation to a counterclockwise direction of rotation.

A fourth feature of the invention is the use of a shaft driven cam which engages a first contact means during its counterclockwise period of rotation to initiate a predetermined flow of water into the tray cavities in preparation for the generation off a new batch of half crescent shaped ice pieces.

A fifth feature of the invention is the use of the shaft driven cam to engage a second contact means to terminate the counterclockwise rotation of the shaft and the leading ejector elements at their dead zero degrees position which occurs when the leading ejector elements are directed downwardly from the shaft into the centers of the tray cavities to divide such cavities into leading and lagging half crescent shaped cavities.

A sixth feature of the invention is the optional us of primary ejector elements of a spring-like material which are flexed backwards opposite the clockwise rotation of the shaft to break the ice bridge between the leading and lagging ice pieces and also to break the ice bond between the leading ejector element and the leading ice pieces to enable the leading ejector elements to spring forward in a clockwise direction and impel the leading crescent shaped ice pieces forward in a clockwise direction along the stripper elements and out of the freezer tray into an appropriately positioned collection bin.

Another optional feature of the invention is one or more protuberances on the back surface of each of the leading ejector elements which becomes frozen in the lagging half crescent shaped ice pieces when the ice pieces are frozen to temporarily prevent the movement of the lagging row of half crescent ice pieces from their original position on the backs of the flexible spring-like leading ejector elements after the flexible spring-like leading ejector elements have been flexed backwards a sufficient amount to break apart the leading and lagging rows of half crescent ice pieces.

BRIEF DESCRIPTION OF THE DRAWINGS

The above and other features and objects of the invention will be more fully understood from the following detailed description of the invention when read in conjunction with the drawings in which:

FIGS. 18–24 show the sequence of operation of another mode of operation for the information of half crescent shaped ice pieces through successive stage of rotation of the ejector elements initially clockwise, with the lagging ice pieces frozen around one or more protuberances on the backs of the leading ejector elements, until the leading and lagging ice pieces are stripped off the leading ejector elements by the ice piece stripper assembly dropped into the external ice piece collection bind, and then the rotation of the shaft and the ejector elements are reversed to a counterclockwise rotation back to ground zero degrees position;

FIGS. 25 and 25*a* (a legend) shows a top view of the freezing tray, the leading set of flexible, spring-like ejector elements after then have rotated about 90° the stripper elements, and the dimensional relationship between the various elements to cause the stripper elements to strip the ice pieces from the ejector elements while at the same time allowing the ejector elements to pass between adjacent stripper elements;

FIG. 26 is a side view of one of the flexible spring-like leading ejector elements;

FIG. 27 is an end view of one of the flexible, spring-like ejector elements;

FIG. 28 shows a front view of one of the stripper elements; and

BACKGROUND OF THE INVENTION

OBJECTS AND BRIEF STATEMENT OF THE INVENTION

BRIEF DESCRIPTION OF THE DRAWINGS

DESCRIPTION OF THE BASIC FORM OF THE INVENTION (FIGS. 1–5)

DESCRIPTION OF THE OPERATION OF THE BASIC FORM OF THE INVENTION (FIGS. 7–17)

Figure 2:
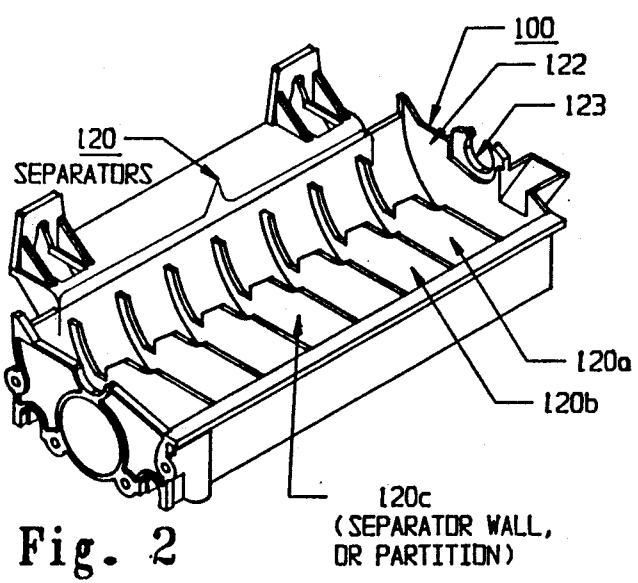
FIG. 2 is an isometric view of the freezer tray with the arcuately shaped inner surface.

DESCRIPTION OF THE OPERATION OF AN ALTERNATIVE FORM OF THE INVENTION (FIGS. 18–24)

DETAILED DISCUSSION OF RELATIONS OF CAVITY WIDTH, EJECTOR ELEMENT WIDTH, AND WIDTH BETWEEN STRIPPER ELEMENTS REQUIRED TO EJECT HALF CRESCENT SHAPED ICE PIECES (FIGS. 25–28)

DESCRIPTION OF THE FUNCTIONAL CONTROL LOGIC OF THE INVENTION (FIG. 29)

DESCRIPTION OF THE BASIC FORM OF THE INVENTION (FIGS. 1–5)

In describing the invention a general description of the partial, broken away isometric view of FIG. 1 will first be described to familiarize the reader with the general structural and operational relationship of the three main parts of the invention including the arcuately shaped, elongated and compartmentalized tray 100 of FIGS. 2, the ejector elements assembly 114 and 116 of FIG. 3, and the stripper assembly 104 of FIG. 4.

Next, each of three above-mentioned main parts of the invention will be described individually followed by a detailed description of the optional flexible, spring-like leading primary ejector elements 11 and finally by the operation of both modes of the invention, as shown in FIGS. 6–23.

It should be noted that throughout all of the figures similar parts are identified by the same referenced character. It is to be also noted that the total ejector assembly 102 of FIGS. 3 has pluralities of elements such as the two groups of ejector elements 114 and 116 which are identified individually by referenced characters 114*a*, 114*b*–114*h*, and 116*a*–116*h*. Similarly, the pluralities of separators 120 and cavities 122 shown in various figures and shown collectively in FIG. 2 are identified individually by referenced characters 120*a*, 120*b*, 120*c*–120*h*, and 122*a*, 122*b*, 122*c*–122*h*. The stripper assembly 104 of FIG. 4 also has its individual stripper elements identified by reference characters 104*a*, 104*b*, 104*c*–104*h*.

Figure 6A:
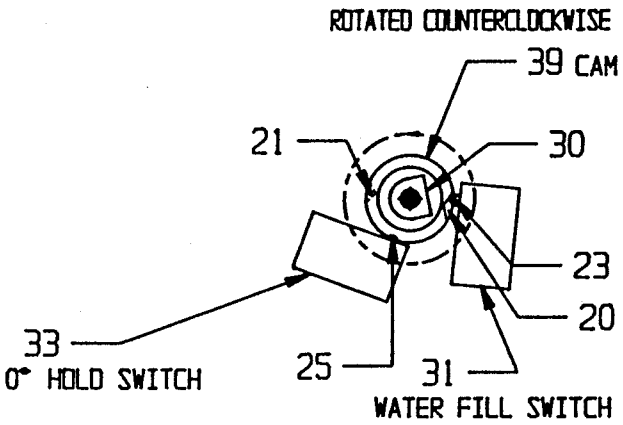
FIG. 6*a* is a front view of the cam structure and the microswitches it controls.
Figure 6B:
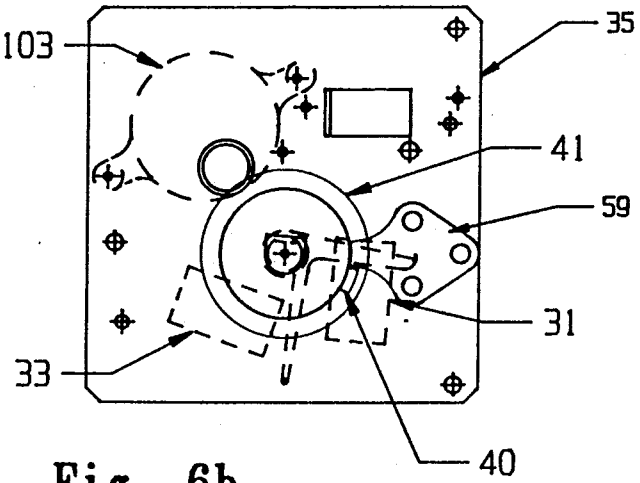
FIG. 6*b* is a front view of the dual level cam, the driving motor and the microswitches.
Figure 6:
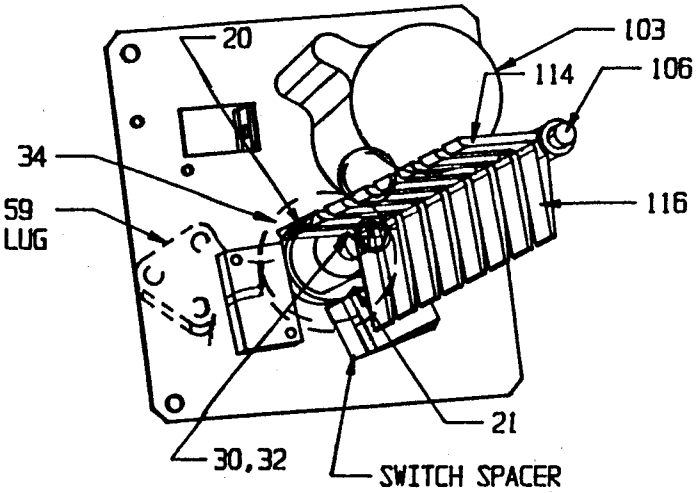
FIG. 6 shows an isometric view of the cam structure which controls the direction of rotation of the shaft assembly.

Before describing the detailed basic form of the invention it is believed that a description of the bidirectional cam 39, the movable lug 40, the stationary lug 59, the notches 20 and 21 and the associated microswitches 31 and 33 and their relationship to the control of the water flow and of the direction of rotation of the shaft 106 and the leading and lagging ejector elements 114 and 116, as shown in the isometric view of FIG. 6 and its auxiliary views FIGS. 6*a* and 6*b*, will be helpful to the reader in better understanding the invention.

Figure 1:
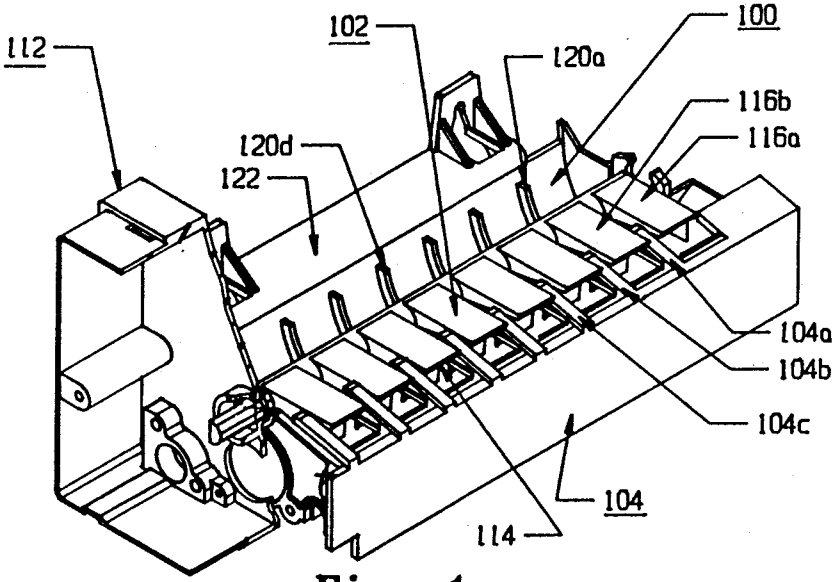
FIG. 1 is a partially broken away isometric view of the basic structure of the ice maker in which the invention operates.

Referring now first to FIG. 6*a* there is shown a front view of the cam 39, the two notches 20 and 21 therein which function respectively to energize the contact switches 23 and 25 (See FIG. 6*a*) which respectively initiate the water flow into the freezer tray cavities 122 shown in FIGS. 1 and 2 and which deenergize the electrical hold contact switch contact 25 (FIG. 6*a*). In FIG. 6 the two notches 20 and 21 in cam 39 can be seen to be on different axial levels along the horizontal rotating axis of cam 39 so that they make contact selectively with only one of the two contact switches 23 or 25 at a given time. More specifically, microswitch 31 will pass and enter water fill notch 20 before the electrical hold ball contact 25 will pass and enter the dead 0° position notch 21 to stop the counterclockwise rotation of the cam 39 in a position such that the leading ejector element 114 will be in its dead 0° position.

The cam 39' has a keyed bore 30 therein which received a mating keyed end 32 of the shaft 106, to which the rows of the leading and lagging rows of ejector elements 114 and 116 are attached but of which only one leading and one lagging ejector element is shown in FIG. 6. The axes of the cam 39' and the shaft 106 are coincident and are rotatably driven by reversible motor 103 (FIG. 6) through motor gear 34 and cam gear 41. A stationary lug or stop 59 (FIG. 6) which is securely fastened to plate 35 by suitable means such as screws and is positioned to intercept the rotatable lug 41 which rotates in synchronism with the shaft 106, after the shaft 106 and leading ejector elements have rotated 31 degrees clockwise from their dead zero degrees position. Stopping the rotation of the motor 103 causes such motor 103 to reverse its rotation to a counterclockwise direction as shown in FIGS. 14–17.

As discussed briefly above, when the water fill notch 20 (see FIGS. 6a) passes the water fill contact 23 (FIG. 6a) a small spring driven ball-shaped water fill contact 23 in the microswitch 31 will spring into the water fill notch 20 to complete circuits in the microswitch 31 which will initiate the flow of water into the freezer tray cavities.

It is to be noted from FIG. 6a that the water fill switch contact 23 is energized when the leading ejector element 114 has rotated 266° counterclockwise from its position after rotating 314° clockwise from its dead 0° position and is still 49° from its dead 0° position at the end of its 266° counterclockwise rotation and which, when rotated another 49° counterclockwise, will mark the end of an ice making cycle.

The end of an ice making cycle is defined herein as the time when the spring loaded ball-like contact 25 (FIG. 6a) conincides with the electrical hold notch 21 on the cam 39 and moves into such notch 21, as shown in FIG. 6a, to stop the rotation of motor 103. It will be noted that the leading ejector elements 114 are then in their dead 0° positions and directed downwardly into the centers of the freezer tray cavities.

Figures 7, 8, 9, 10, 11, 12:
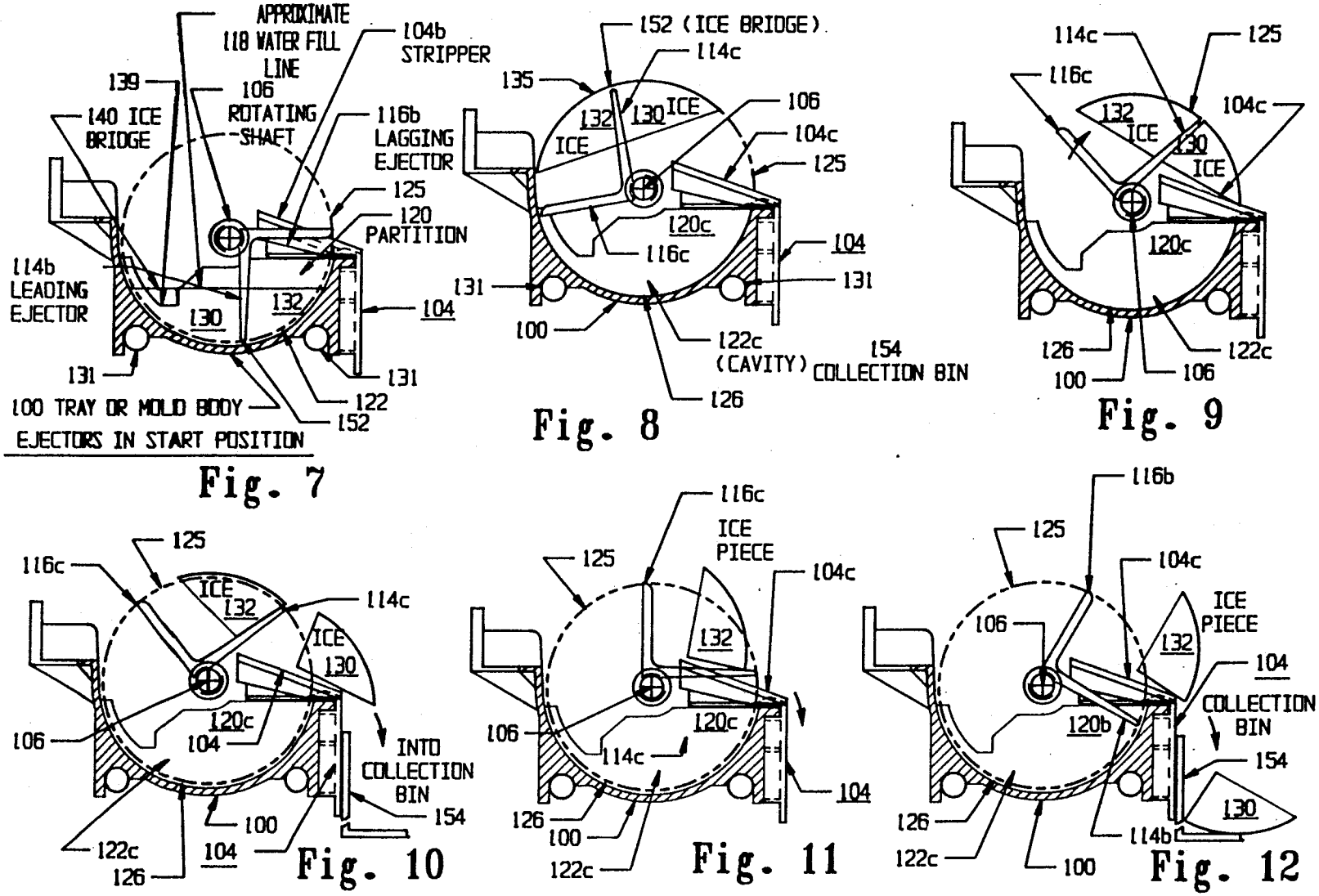
FIGS. 7–17 (including FIG. 13*a*) show the sequence of operation of one preferred embodiment of the invention for the formation of half crescent shaped ice pieces through successive stage of rotation, both clockwise and counterclockwise, of the ejector elements until both the leading and lagging half crescent shaped ice piece are stripped by the ice stripper assembly and dropped into the external collection bin, and the shaft and its attached ejector elements returned to their initial dead zero degrees starting position with the leading ejector elements extending from the shaft downwardly into the center of the freezing tray cavities.
Figure 13:
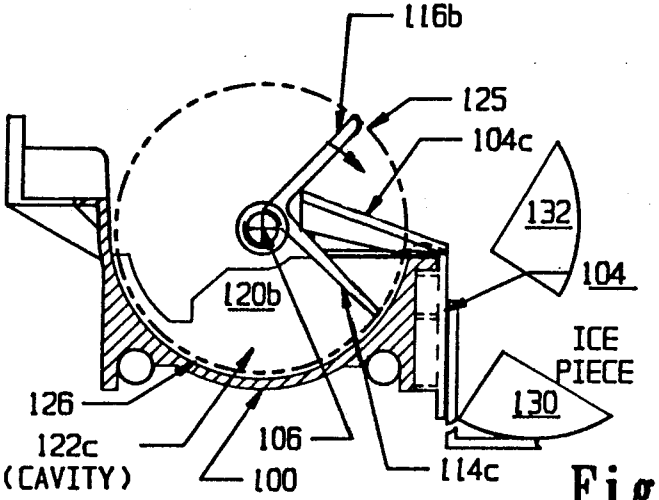
Figure 14:
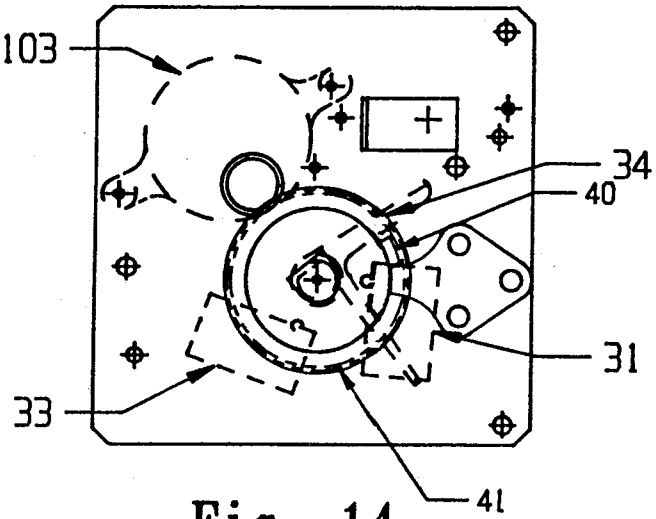

Referring now specifically to FIG. 1 an ice piece freezer tray (or mold) 100, shown separately in FIG. 2, has rotatably secured therein an ejector element assembly 102 (shown separately in FIG. 3) comprising a reversible rotatable shaft 106 having two sets of ejector elements 114 and 116 (see FIG. 3) secured thereto separately and functionally to rotatably eject the two sets of half crescent ice pieces (see FIGS. 7–17) from the cavities 122 in the tray 100 in which they were formed, and an ice piece stripper assembly 104 (shown separately in FIG. 4) for stripping the two sets of half crescent shaped ice pieces from the ejector elements 114 of the ejector assembly 102, with the rotatably leading set of half crescent ice pieces 130 (see FIGS. 7–13) being stripped from the ejector elements 114 of the ejector assembly 102 by stripper assembly 104 and dumped into a collection bin (154 of FIG. 12) when the ejector assembly 102 has rotated the leading crescent shaped ice pieces 114 about 314° clockwise from their original position of FIG. 7 when they were formed, and the lagging set of half crescent ice pieces 132 (see FIGS. 10–13) subsequently being stripped from the ejector assembly 102 and dumped into the collection bin (FIG. 12) when the ejector elements 114 and 116 of the shaft assembly 102 have rotated clockwise about the rotatable axis 106 about 314° as shown in FIG. 14.

The manner in which the stripper elements 104 are constructed and how they strip the half crescent shaped ice pieces from the leading ejector elements 114 is unique and will now be described before proceeding with the action of the spring-like leading ejector elements 114.

Figure 4A:
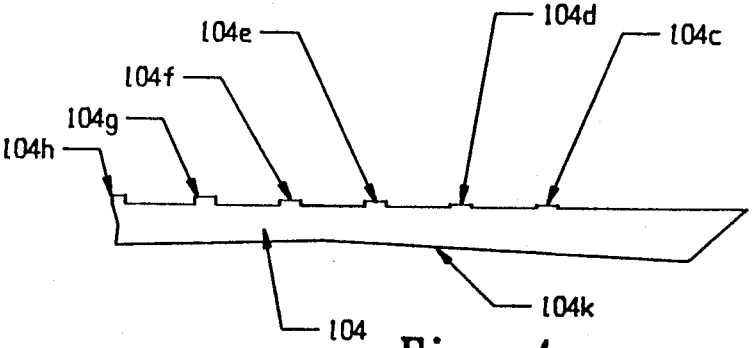
FIG. 4*a* shows a back view of the stripper elements and their graduated heights.
Figure 4:
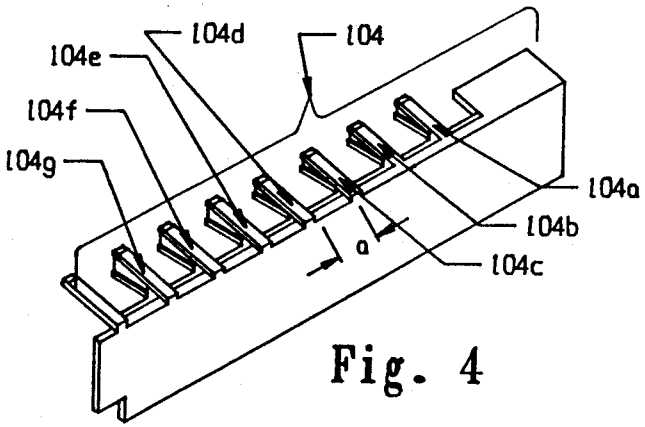
FIG. 4 is an isometric view of the ice stripper assembly.

Referring now to FIG. 4a there is shown a profile of the stripper elements as seen from rear of the stripper element support 104k which is to be considered to be in the plane of the drawing sheet on which support 104k is drawn. The pair of stripper elements 104g and 104h can be seen to extend higher above the top of the support 104k than the adjacent pair of stripper elements 104e and 104f, which in turn extend higher above the support 104k than do stripper elements 104c and 104d. Although not visible in FIG. 4a stripper elements 104a and 104b extend upwards slightly less than the top of support element 104k and thus are lower than the upward extension of stripper elements 104c and 104d.

Now since the tips of all of the leading ejector elements 114 lie in a straight line parallel to the axis of shaft 106 the leading ejector element 114h and 114i will impact the stripper elements 104f and 104g before leading ejector element 114g will impact stripper elements 104h and 104g, and leading ejector element 114g will impact stripper elements 104h and 104g before leading ejector element 114f impacts stripper elements 104g and 104f, thus distributing the shock of the impacts of the leading ejector elements 114 over an interval of time, albeit short, rather than have all of the impacts occur simultaneously and incur some risk of stalling the motor 103 prematurely (see FIG. 6).

In the present invention the flexing action of spring-like leading ejecting elements 114 is not of ultimate importance in separating the leading and lagging ice pieces when the leading ice pieces impact the stripper elements. In fact both the leading and lagging ejector elements 114 and 116 can be still, i.e. without a flexible spring-like motion, such as is in FIGS. 6–11 of U.S. Pat. No. 5,056,321, issued Oct. 15, 1991 to Kenneth H. Patrick and incorporated herein in its entirety by reference.

Without the flexible, spring-like leading ejector elements 114, however, the separating of the leading and lagging ejector elements 114 and 116 depends almost entirely upon the torque created by the ice bridge 152 connecting the leading and lagging half crescent shaped ice pieces when the leading ice pieces impact the stripper elements 104 during their clockwise direction of rotation period.

Nor is the protuberance 121 on the back side of the leading ejector elements 114 absolutely necessary to the operation of the present invention, as shown in FIGS. 18–24 herein. Each of the leading and lagging ejector elements could be of a rigid material in lien of a spring-like material for the leading ejector elements.

The reversal of the motor 103 (FIG. 14) which drives the shaft 106 and the leading and lagging ejector elements 114 and 116 after the have been rotated in a clockwise direction 314° from their dead 0° position is the primary function which insures that a cycle of making half crescent shaped ice pieces is completed without mishap such as stalling the motor 103 or leaving errant ice pieces in the freezing tray 100.

The rotatable shaft 106 is supported at one end by a bearing (not shown) which is within the prime driver and control mechanism housing 112, and at the other end by a bearing (not shown) near the curved slot 123, also shown in FIG. 2, in a manner so that the axis of shaft 106 is coincident with the radial axis of the arcuately shaped freezer tray 100. The individual ejector elements of the two sets of ejector elements 114 and 116 are rigidly secured at one end to the rotatable shaft 106, as mentioned above, with each set of such ejector elements 114 and 116 extending along the entire length of the rotatable shaft 106, and further with each set of ejector elements 114 and 116 lying along separate common planes both of which are parallel to the axis of rotatable shaft 106.

The relative positions of the two sets of ejector elements 114 and 116, with respect to their initial position after water has been injected into tray 100 to level 118 (see FIG. 5) and then frozen into crescent shaped ice pieces, as such ejector elements 114 and 116 are rotated, are shown representatively in the cross sectional view of a selected one of the cavities in FIGS. 7–17.

It is to be further specifically noted, as discussed briefly above, that each ejector element of the set of flexible, spring-like primary ejector elements 114 extends downwardly from the shaft 106 and into the center of one of the crescent shaped cavities 122 (see FIGS. 5 and 7) which is bounded by adjacent vertical separators or partitions 120 on either side thereof and by the arcuately shaped (curved) inner surface of the freezer tray 100 on the edges thereof. The cavity 122 if filled to the predetermined level 118 with water (FIGS. 5 and 7) which, when frozen, will form a full crescent shaped ice piece but with the flexible, spring-like ejector element **114*b* frozen in the center thereof. Thus, each of the leading ejector elements 114 divides each of such cavities 122** into two half crescent shaped cavities within which are formed into two half crescent shaped ice pieces.

Figure 5A:
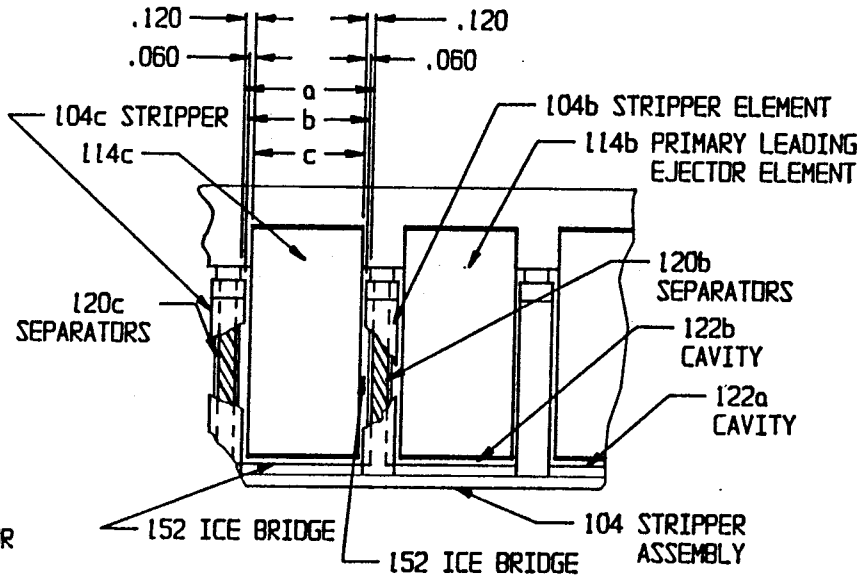
FIG. 5*a* is a partial cross-sectional view of FIG. 5 to illustrate more clearly the spatial relation between the leading ejector elements, the cavity separators, the rotating shaft, the ice pieces, and the ice bridge formed between adjacent full crescent shaped ice pieces.
Figure 5:
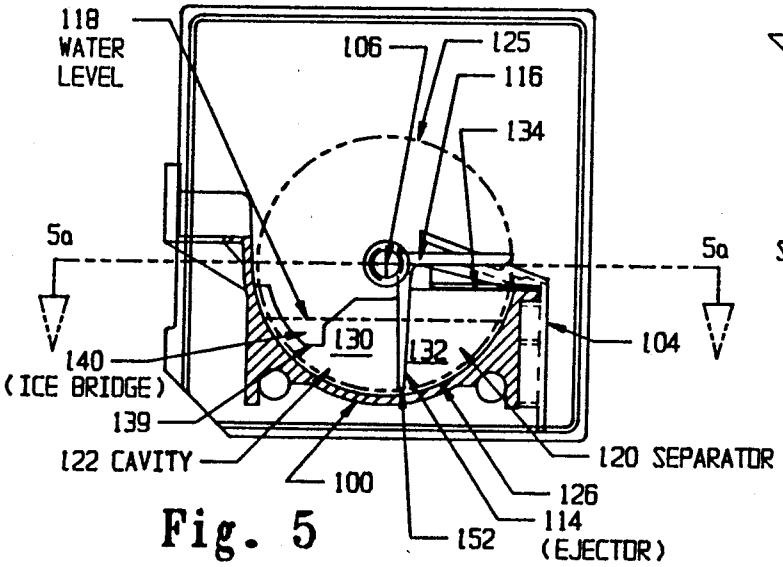
FIG. 5 is a combination end view and cross-sectional view of the half crescent shaped ice pieces maker including the basic controls for causing the shaft and the attached rows of leading row of ejector elements to rotate clockwise from their dead zero degrees position to an angular amount X° past the stripper elements to strip the leading and lagging half crescent shaped ice pieces from the leading ejector elements to a stop means which stops the clockwise rotation of the shaft and reverses the shaft rotation to a counterclockwise rotation, thereby picking up any ice pieces that did not successfully exit the freezer tray on the clockwise rotation of the shaft and depositing such errant ice pieces out of the freezer tray. Also shown in FIG. 5 is a side view of the stripper elements.

The second set of ejector elements 116 extend outwardly to the right from shaft 106 in FIG. 5 and are positioned over the water level 118 The angular distance from ejector elements 116 to the leading primary ejector elements 114, measured in a clockwise direction of rotation is about 75°–90°. The shaft 106, and therefore both sets of ejector elements 114 and 116, rotate initially in a clockwise direction, but only after the crescent shaped ice pieces have become frozen in their respective crescent shaped cavities 122.

It is apparent that, if desired, the set of leading ejector elements 114 can be designed to be positioned in their crescent shaped cavities at selected angular distances on either side of the position shown in FIG. 5 to divide the full crescent shaped ice piece into two unequal portions of the initially crescent shaped ice piece. As the shaft 106 and the two sets of ejector elements 114 and 116 are rotated clockwise through 314° the rows of leading and lagging ice pieces 130 and 132 are broken apart by the impact of the leading half crescent ice piece with the stripper elements 104 and then dumped into an external collection bin 154 (shown in FIGS. 10 and 12) as two sets of different sized partial crescent shaped ice pieces, with each set of ice pieces being either slightly greater or slightly less in size than the half crescent ice pieces formed by the positioning of the ejector elements 114 as shown in FIG. 5.

The paths of the tips of the rotating sets of ejector elements 114 and 116 can, if desired, be coincident and are represented by the dashed line circle 125 in FIGS. 5, 7, and 8, which sweeps close to, but does not contact, the arcuately shaped bottom 126 of the freezer tray 100.

It is important to note that there is a bridge of ice 152 (see FIGS. 7, 8 and 9) connecting the two half crescent ice pieces 130 and 132 (of a single full crescent shaped ice piece) of FIGS. 8–13 in each of the cavities 122, and on either side of, and at the tip of the ejector element **114*b*. It is this bridge of ice 152 around ejector elements 114*b* (see FIG. 5*a*) that connects to and helps pull the lagging half crescent shaped ice piece 132 along with the leading half crescent shaped ice pieces 130 as the leading half crescent shaped ice piece 130 is rotated by the flexible, spring-like primary ejector element 114*b* in a clockwise direction around the rotating shaft 106 which is being rotated by a suitable drive mechanism (the motor 103 of FIG. 6). The spacing between the edges of the flexible, spring-like ejector elements 114 and the cavity separators 122** also allows water to flow from the leading half crescent shaped cavities to the lagging half crescent shaped cavities to ensure a full crescent ice piece when the water freezes.

As mentioned above, the width c of the ejector elements, such as ejector elements **114*c* (FIGS. 5*a*, 24 and 24*a*) is slightly less (typically 0.120") than the cavity 122*b*, in which the ejector elements 114*a*–114*h* which join the rotatively lagging half crescent ice pieces 132 to the leading half crescent ice pieces 130** of the same full crescent ice pieces.

It is to be noted that each ice piece of the lagging row of ice pieces 132 also is frozen to the back side of one of the leading flexible, spring-like ejector elements 114.

To more fully understand the coaction between the rotating ejector elements 114 and 116 and the stripper assembly 104, which strips the notched, full crescent shaped ice pieces from the ejector elements 114 and 116, the relative dimensions of the width of the ejector elements 114, the distance "b" between adjacent stripper elements **104*b* and 104*c*** of the stripper element assembly and the width of the crescent shaped ice pieces must be considered.

Reference is now made more specifically to FIG. **5*a* which shows the relationship between the width of the ice pieces, the width "c" of the ejector elements 114*c*, and the distance "a" between adjacent separator elements 120*b* and 120*c***.

In FIG. **5*a* the distance "a" between adjacent cavity separators 120*b* and 120*c* determine the width of the now ejected crescent shaped ice piece 130 which can be seen to be greater than the distance "b" between the adjacent stripper elements 104*b* and 104*c* by 0.120" (0.060" on each side of the ice piece 130), also shown in FIG. 25 and 25*a***.

The width "c" of ejector elements **114*c* is less than the width of ice piece 130 by 0.120" on each side of the ejector element 114. Thus, while the ejector element 114*c* will pass through adjacent stripper elements 104*b* and 104*c* in FIG. 5*a* by 0.060" on both sides of ejector element 114*b*, the ice piece 130 will be intercepted by the adjacent stripper elements 104*b* and 104*c* by 0.060" on both sides of the ice piece 130 to stop the rotation of ice piece 130, as shown in FIGS. 5*a* and 25. However, the ejector element 114*c* will continue to rotate to push the half crescent shaped ice piece 130 outwardly from the rotating shaft 106 to which the ejector element 114*c* is attached, as discussed above, and along the top surfaces of the adjacent stripper elements 104*b* and 104*c*, and ultimately outside the freezer tray cavity 122*b* and into a collection bin 154 (as shown in FIGS. 8, 10, and 12**).

A more detailed showing and discussion of the relationship between the ejector elements 114, the stripper fingers of stripper assembly 104, and the ejection of the ice pieces as the shaft 106 is rotated is shown in FIG. 25, which will be discussed later herein.

Referring again to FIG. 5 the top portion 134 of separator 120 preferably is at the same level as the short extension 134' thereof. Between the top levels 134 and 134' of separator 120 is a lowered portion 139 thereof. Ice bridges 140 are formed between adjacent leading half crescent shaped ice pieces 130 across the lowered portion 139 of separators 120, such as separator 120c. These ice bridges 140 join together all of the leading hal crescent shaped ice pieces 130 into a solid row 130 of leading half crescent shaped ice pieces so that they, together with the ice bridges 152 of FIG. 5a and the freezing of the leading and lagging rows of half crescent ice pieces to the flexible, spring-like ejector elements 114, will join together the leading and lagging rows of half crescent ice pieces and will pull the lagging row 132 of half crescent shaped ice pieces along with the leading half crescent shaped ice pieces 130 as the leading half crescent shaped ice pieces 130 are rotated by the flexible, spring-like ejector elements 114, until they are separated by the stripper elements 104 which have graduated heights and are impacted by the leading ejector elements at slightly different times, as discussed above in connection with FIG. 4a.

Figure 13A:
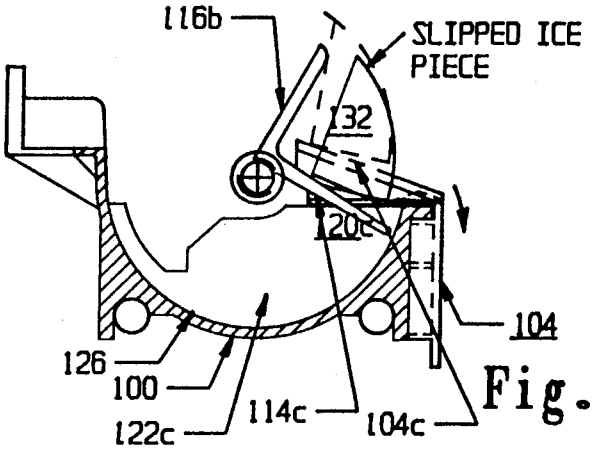
Figure 15:
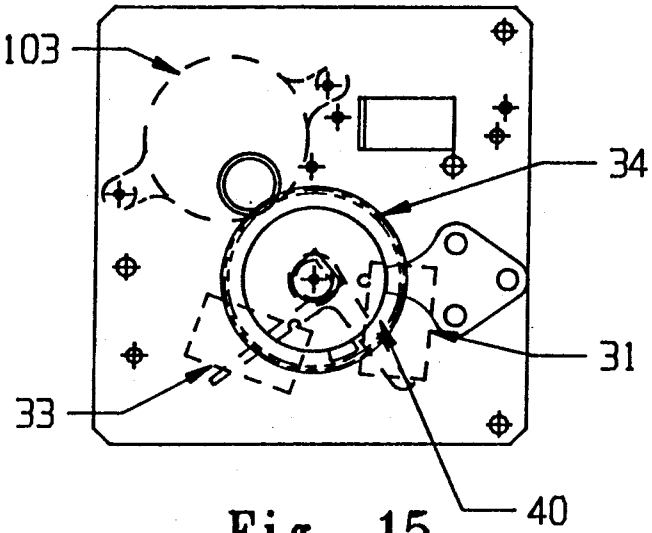

While it is unlikely that any half crescent shaped ice pieces will break off from the full crescent shaped ice pieces 135 (FIGS. 8 and 9) prematurely and fall back into the tray 100, such an event could occur. In the event that a half crescent shaped ice piece accidentally does fall back into the tray 100, the ice maker is so designed that the rotation of the shaft 106 and the leading and lagging ejector elements will be reversed after the shaft has rotated 314° and will pick up any such stray, fallen half crescent ice pieces and lift them up, as shown in FIG. 13a to a sloped level (Also see Sec. VI) to enable them to slide off the leading ejector elements 114 and out of the freezer tray 100.

DESCRIPTION OF THE OPERATION OF THE BASIC FORM OF THE INVENTION FIGS. 7-17)

Referring now to FIGS. 7-13, there is shown the sequence of operation of ejecting the frozen crescent shaped ice pieces into an external collection bin 154 (FIGS. 8, 10 and 12) in the form of half crescent shaped ice pieces rather than full crescent shaped ice pieces. Before discussing FIGS. 7-13 it is to be noted that in FIGS. 7-13, the ejector elements 114c and 116c are shown in front of stripper element 104b in order to avoid showing the various control details shown in FIGS. 6, 6a and 6b.

Assume now that the full crescent shaped ice pieces are completely formed and that the tray 100 and separators 120 (FIG. 2) have been heated by a large "U" shaped heater element 131 which extends along the bottom of the freezer tray 100 (see FIGS. 7 and 8) to release the full crescent shaped ice pieces from the freezer tray 100 and the separators 120 so that rotation of the full crescent shaped ice pieces can now occur without being bonded (by freezing) to any part of ice tray 100.

As is apparent, FIGS. 7 through 13 are a form of schematic representation showing the interaction of only one cavity, one full crescent shaped ice piece, and one each of the ejector elements 114 and 116. FIGS. 18-24, which show an alternative form of the invention, also show the interaction of only one cavity, one full ice piece, and one each of the ejector elements 114 and 116.

The positions of the full crescent shaped ice pieces and the ejector elements 114c and 116c after about 165° of clockwise rotation are shown in FIG. 8. In FIGS. 9 and 10 the positions of ejector elements 114c and 116c are shown after rotating about 195° and 210°, respectively. In FIG. 8 the ice piece has retained its unified, full crescent shape while in FIG. 9, after a rotation of about 228° the leading half crescent ice piece 130 has just impacted the two adjacent stripper elements 104b (and 104c) and consequently has just broken away from the lagging half crescent ice piece 132 and is beginning t be pushed down the two adjacent stripper elements 104b and (104c) towards the edge of the tray 100 and ultimately over the edge of the tray 100 and into the collection bin 154 (see FIG. 12).

In FIG. 10 the ejector elements 114c and 116c are shown as having rotated about 233° with the ejector element 114c being in a position to be just at the point of pushing the leading half crescent ice piece 130 over the edge of the stripper assembly 104.

In FIGS. 11 and 12 the ejector elements 114c and 116c are shown as having rotated about 27020 to about 300°, with the leading half crescent ice piece 130 having been completely pushed off the stripper element 104c and the lagging half crescent ice piece 132 being pushed onto and along the stripper element 104c towards the collection bin 154.

As shown in FIG. 13, after the ejector elements 114c and 116c have rotated another 14° the lagging half crescent shaped ice piece 132 is shown being pushed off the stripper elements 104b and 104c (FIG. 13) and into the collection bind 154, and the ejector elements 114c and 116c will be ready to begin their counterclockwise rotation. The travelling lug 40 of cam 39 will have impacted stationary lug 59 of FIG. 6b which determines the end of 314° of clockwise rotation of shaft 106 and ejector elements 114. FIG. 6b also shows the relationship between the motor 103, the motor gear 34, the stationary and movable lugs 59 and 40, the ejector elements, and the cam 39.

It should be noted that the clockwise rotation of the shaft 106 terminated after 314° of rotation because the clockwise rotation of the rotating lug 40 impacts abruptly against the stop element or lug 59, which stalls the motor 103 driving the shaft 106 and causes the motor 103, and thus the shaft 106, to reverse rotation to a counterclockwise direction.

When the shaft and the ejector elements have rotated about 233° counterclockwise from their maximum 314° clockwise rotation as shown in FIG. 13 a water fill directing notch 20 in the now counterclockwise rotating cam 39 (see FIG. 6) will enable a water fill contact switch 23 (see FIG. 6a) to initiate the flow of water into the freezing tray cavities to a predetermined level in the cavities.

Figure 17:
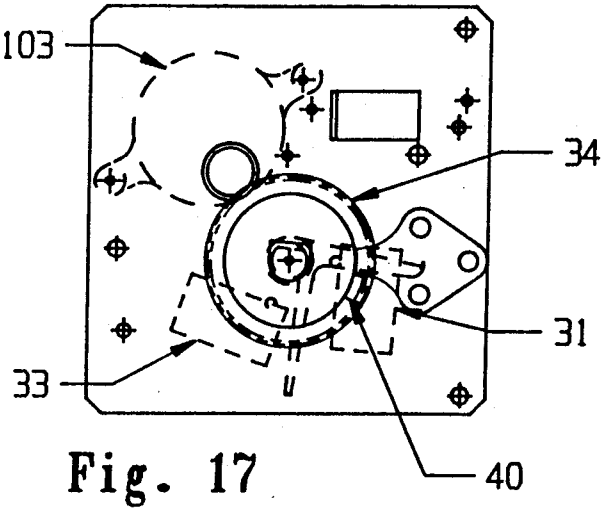

The leading ejector elements 114 will continue its counterclockwise rotation, without pause, through the water fill initiating cycle point to the electrical hold position, as shown in FIG. 17, at which time the shaft 106 and the leading ejector elements 114 will be in their dead 0° position pointed directly downward into the center of the freezer tray cavities as shown in FIGS. 5 and 7.

It should be noted that when the leading ejector element reaches its dead 0° position as shown in FIG. 17 a second notch 21 (FIG. 6a) deenergizes the electrical hold contact switch 25 of FIG. 6a.

As discussed above, only the leading row 130 of half crescent shaped ice pieces 130 have an ice bridge (ice bridge 140 of FIGS. 5 and 7) formed between adjacent ones of the (primary) leading row 130 of half crescent shaped ice pieces. The lagging row 132 of half crescent shaped ice piece (such as lagging half crescent shaped ice pieces 132 of FIGS. 5 and 7) has no corresponding ice bridges connecting adjacent lagging half crescent shaped ice pieces. The lagging row of half crescent shaped ice pieces 132 should easily break apart from each other before they fall into the external collection bin 154 and form separate half crescent shaped ice pieces because of the varying heights of the stripper elements 104.

It might sometimes be desirable to form connected groups of two, three, or more half crescent shaped ice pieces as they are collected in the collection bin. The formation of groups of selected numbers of half crescent shaped ice pieces is easily accomplished by decreasing or increasing the size of the lowered portion 139 of selected ones of the separators 120 and adjusting the heights of the stripper elements 104 to be the same for an increased number of consecutive stripper element. This will change the size of the ice bridge 140 between selected adjacent ones of the leading row of half crescent shaped ice pieces and thereby facilitate their breaking apart in different size groups of leading half crescent shaped ice pieces.

DESCRIPTION OF THE OPERATION OF AN ALTERNATIVE FORM OF THE INVENTION

Figure 3B:
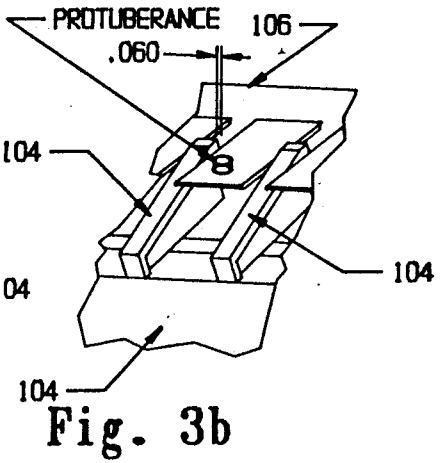
FIG. 3*b* is an isometric view of another form of the flexible spring-like leading ejector elements with a stripper element positioned on either side thereof and with a protuberance on back side thereof facing the lagging row of half crescent shaped ice pieces.
Figure 3A:
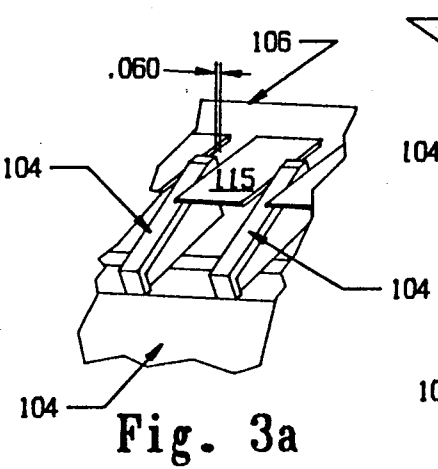
FIG. 3*a* is an enlarged isometric view of one form of the flexible, spring-like element with a stripper element on either said thereof.
Figure 3:
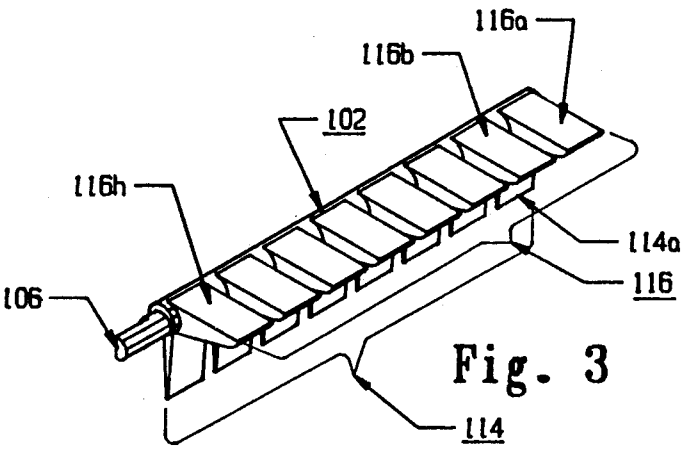
FIG. 3 is an isometric view of the ice piece ejector elements assembly including the shaft and two rows of ejector elements.

In a second form of the invention, as shown in FIG. 3*b*, the flexible, spring-like ejector element 114*c* has a small protuberance 121 thereon, which can be one or more short button-like elements or rod-like structures secured to the back surface of the leading ejector element 114*c* which faces the associated lagging half crescent shaped ice piece 132 and which is frozen therein at the beginning of an ice making cycle as shown and described with respect to FIGS. 18–24. The front surface of ejector element 114 preferably is smooth.

The purpose of the small protuberance 121 frozen into the lagging half crescent ice pieces 132 is to prevent the lagging half crescent shaped ice pieces 132 from falling, i.e. sliding downwardly or sidewise off the flexible, spring-like ejector element 114, and down between adjacent ejector elements to jam the equipment, as shown in FIG. 13*a*, after the bonding ice bridges 152 between the leading and lagging half crescent shaped ice pieces (130 and 132) have been broken by the flexing backward of the flexible, spring-like ejector elements 114 when the leading row of half crescent shaped ice pieces 130 impacts the stripper elements 104, and by the difference in height of the stripper elements 104, as discussed above.

Figure 18:
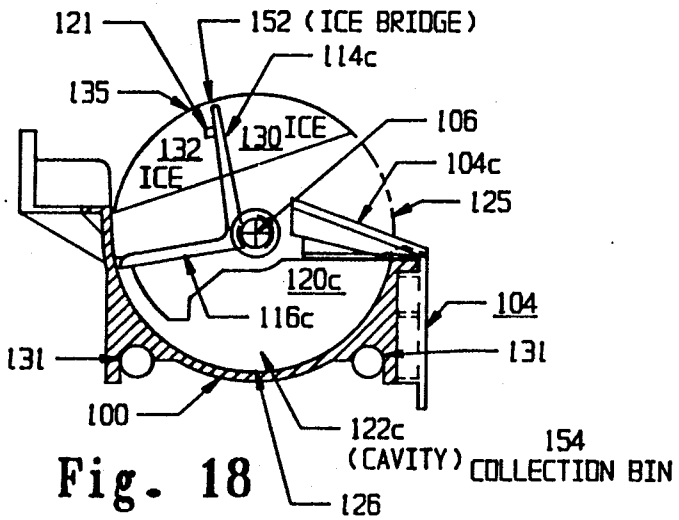

In FIGS. 18–24 only a portion of the full cycle of the second form of the invention is shown. FIG. 18 shows the ejector assembly and the full crescent ice piece 135 after being rotated about 160° from the dead 0° position of the leading ejector elements 114 and with the full crescent ice piece 135 not yet having impacted the stripper element 104*b* (and 104*c*). Actually only stripper element 104*b* is shown in FIGS. 18–24.

Figure 19:
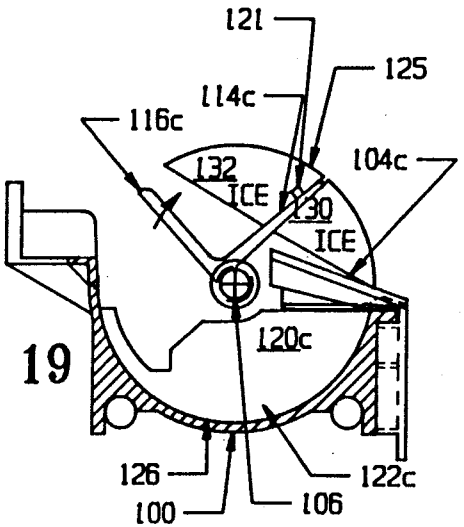
Figure 16:
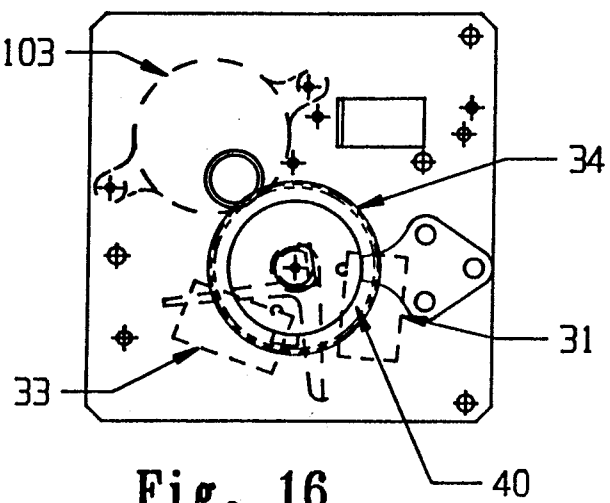

In FIG. 19 the ice piece is shown immediately after impacting the stripper element 104*b*. The leading resilient spring-like ejector element 114*c* has been bent back opposite the direction of rotation of shaft 106, thereby breaking the leading resilient spring-like ejector element 114*c* from the lagging half crescent ice piece 132, and also breaking the ice bridge 152 between the leading and lagging half crescent ice pieces 130 and 132.

Figure 20:
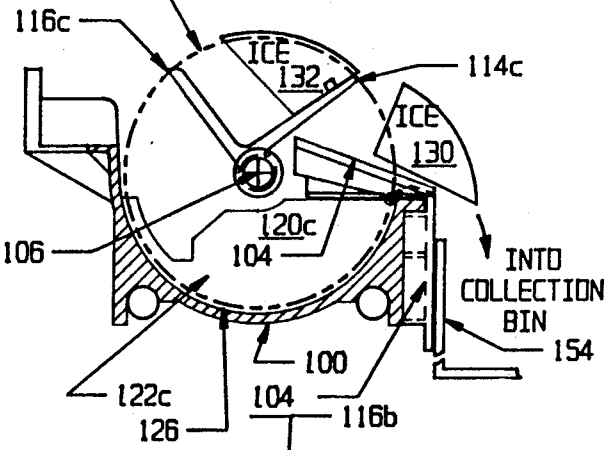

However, the protuberance 121 remains embedded in the lagging half crescent ice piece 132 as shown in FIG. 20 to restrain movement of the lagging half crescent ice piece 132 on the back surface of the leading resilient, spring-like ejector element 114*c*.

Immediately after the ice bonds between ice pieces 130 and 132 and spring-like ejector element 114*c* are broken the leading spring-like ejector element 114*c* will spring forward, as shown in FIG. 20 and impel the leading half crescent ice piece 130 forward along the top of the stripper elements 104*b* (and 104*c*) towards the edge of the freezer tray 100.

Figure 21:
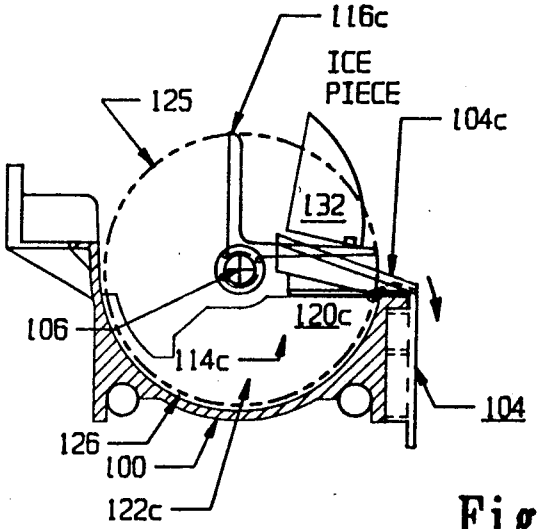
Figure 22:
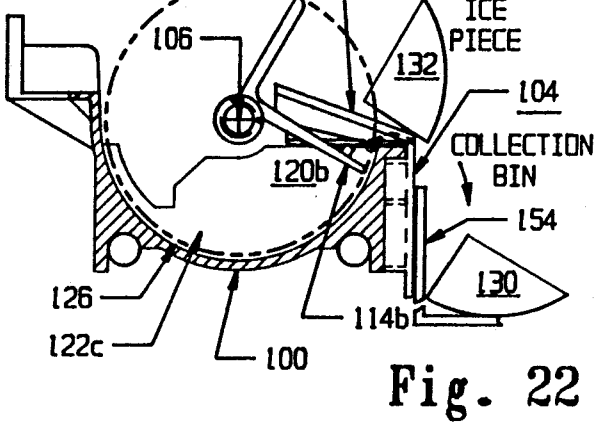

In FIGS. 21 and 22 the leading half crescent ice piece 130 has been shown pushed off the edge of freezer tray 100 via the stripper element 104*b* (104*c*) and into the collection bin 154 (FIG. 22). Also the lagging half crescent ice piece 132 is shown just before it impacts the stripper elements 104*b* (and 104*c*) in FIG. 21, and in FIG. 22 the lagging ice piece 132 is shown just after being stripped from the back side of the leading resilient, spring-like element 114*b* and has pulled the protuberance 121 out of the lagging half crescent ice piece 132, thereby freeing the ice piece 132 to slide down stripper elements 104*b* (and 104*c*) and into the external collection bin 154.

Figure 23:
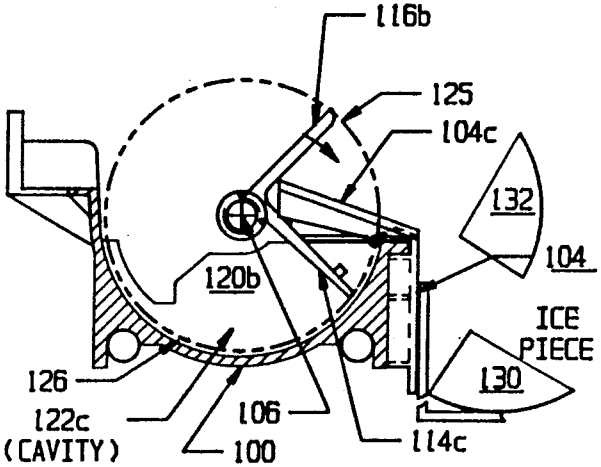

It can be seen in FIGS. 22 and 23 that as the lagging ejector element 116*b* continues to rotate it will push the lagging half crescent ice piece 132 along and off the stripper elements 104*b* (and 104*c*) and then over the edge of the freezer tray into collection bin 154. FIG. 24 shows the completion of the cycle and ejector elements 114*c* and 115*c* waiting for water to be injected into the freezer tray 100, frozen, and then rotated through the steps shown in FIGS. 18–24 to make a new batch of half crescent shaped ice pieces.

Referring now to prior art U.S. Pat. No. 3,362,181 issued Jan. 9, 1968 to Linstromberg there is shown in FIGS. 3, 4, 5, 7, 11 thereof a control mechanism including sensors, a motor, a motor drive means responsive to signals from the sensors to operate the required sequential operating steps of the present invention. More specifically the Linstromberg U.S. Pat. No. 3,362,181 shows and describes a motor drive arrangement, including a driving motor 204 in columns 8 and 9 thereof for providing the torque necessary to rotate the shaft 189 of FIG. 5 thereof and therefore also to rotate the ejector elements 188 of FIG. 4 thereof to eject the crescent shaped ice pieces formed in the freezing tray mold 126 (FIG. 1 of U.S. Pat. No. 3,362,181) in response to a signal generated by thermostat 254 of Linstromberg. The rotation of shaft 189 of Linstromberg also activates the control means for sequentially operating the various processing steps for the ice maker described therein, such as injection of water into the freezing ray, freezing the ice pieces, heating the freezing tray, and the beginning and the terminating of the rotation of shaft 189.

The ejector assembly 131 of U.S. Pat. No. 3,362,181 is arranged to operate at a low torque permitting the use of plastic parts in the drive and ejector structure and providing improved safety of operation.

More specifically, the various sequences of operation of the Linstromberg U.S. Pat. No. 3,362,181 include injecting a measured and time controlled amount of water into the freezing mold 126 thereof described in columns 9, 10, and 11 of U.S. Pat. No. 3,362,181, freezing the water to a desired temperature as described in columns 5 and 6 thereof, heating the mold 126 to release the frozen full crescent shaped ice pieces therefrom to permit the full crescent shaped ice pieces to be pushed out of the freezing tray 126 by the rotating ejector elements described in columns 6 and 7 of Linstromberg, then stripping the ice pieces from the ejector elements 131 by the stripper 208 (FIG. 4) thereof, and finally dumping the ice pieces into an ice piece receiving bin 118 (see FIG. 1 of U.S. Pat. No. 3,362,181).

The control mechanisms shown in FIGS. 7 and 11 of Linstromberg are driven by motor 204, as mentioned above, to orchestrate the sequence of operational steps of Linstromberg's full crescent shaped ice piece maker and prepare the ice maker control means of FIGS. 7 and 11 of U.S. Pat. No., 3,362,181 for the freezing and ejection of the next batch of ice pieces.

The entire torque generating means (including the motor 204 of Linstromberg and the entire control structure for initiating and terminating all of the operational steps in the initiating and terminating all of the operational steps in the proper sequence and at the proper times) can be employed in the present invention, although only generally described herein. Accordingly, the entire driving and control structure of U.S. Pat. No. 3,362,181, as well as an other structure thereof required to drive the rotating shaft 106 of the present invention and generally to initiate and terminate all of the steps necessary to repeatedly form half crescent shaped ice pieces at the proper times and in the proper sequence is hereby incorporated herein in the present specification by reference, although different from the steps of the present invention in that the shaft of Linstromberg does not reverse its direction of rotation.

DETAILED DISCUSSION OF RELATION OF CAVITY WIDTH, EJECTOR ELEMENTS WIDTH, AND WIDTH BETWEEN STRIPPER ELEMENTS REQUIRED TO EJECT HALF CRESCENT SHAPED ICE PIECES (FIGS. 24–27)

In FIGS. 25–28 there are shown views of the leading row of ejector elements 114, the stripper assembly 104, the rotating shaft 106, their spatial relationship, and the shapes of the individual leading ejector elements 114, such as ejector element **114*b*, and the shape of the individual stripper elements, such as stripper elements 104*b* and 104*c* of the stripper assembly 104**.

Careful examination of FIG. 25 reveals that the width "c" of each of the flexible, spring-like ejector elements 114, such as flexible, spring-like ejector element **114*b* is slightly less (about 0.120") than the distance between adjacent stripper elements, such as stripper elements 104*b* and 104*c*, with about 0.060" clearance on both sides thereof. However, as will be described below, the ice pieces, whose width is greater by 0.120" than the distance between stripper elements 104*b* and 104*c*, is not able to pass between the adjacent stripper elements 104*b* and 104*c* and will therefore be stripped from ejector element 114*b***. The foregoing will become clearer from the following text.

The distance X=0.060" in FIG. **25*a* represents the distance between the edge of a stripper element 104*b* and the edge of a flexible, spring-like ejector element 114*b*. The distance Y=0.120" is the distance between the surface of the separator 120*b* and the edge of an ejector element 114*b*. It can be seen therefore in FIG. 25 that width of the ice piece formed between adjacent separators 120*b* and 120*c* is about 0.120" greater than the distance between the adjacent stripper elements 104*b* and 104*c* and will therefore impact upon the adjacent stripper elements 104*b* and 104*c* by about 0.060" on either side of the ice piece and accordingly will be stripped from the ejector elements 114*b* such as ejector element 114*b* of FIG. 25, and will be pushed into the collection bin 154 (FIGS. 10 and 12) by the continuing-to-rotate leading ejector element 114*b***.

FIGS. 26 and 27 respectively show a side view and an end view of a leading ejector element **114*b***.

FIG. 28 shows an end view of a stripper element **104*c*, and its supporting element 104*k*, which supports all of the stripper elements 104*a*–104*i*. Reference character 104*x*** shows the underlying vertical support element of the stripper element.

DESCRIPTION OF THE FUNCTIONAL CONTROL LOGIC OF THE INVENTION

Figure 29:
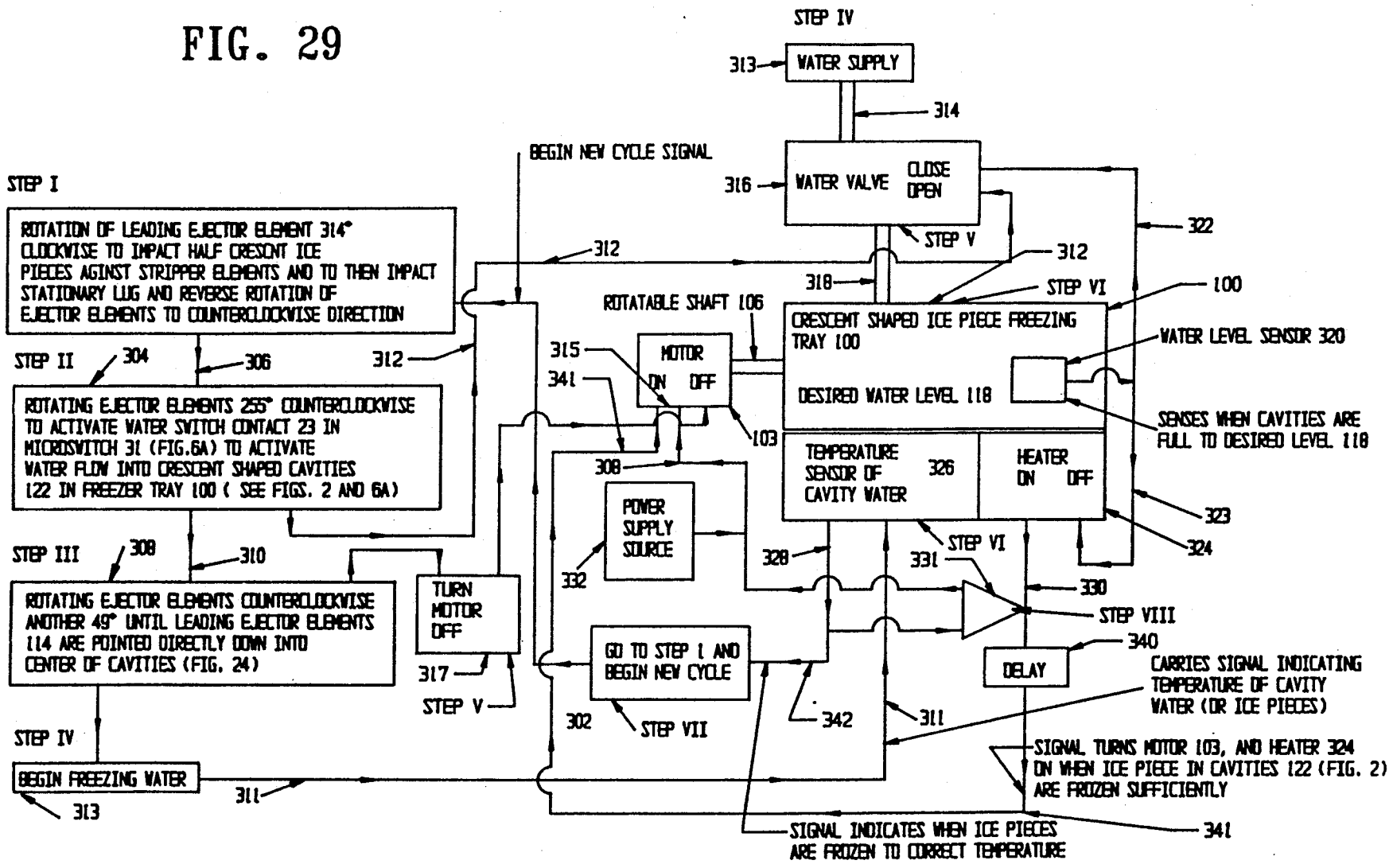
FIG. 29 shows a functional diagram of the control logic which controls the sequence and order of the steps required to manufacture the half crescent shaped ice pieces of the present invention.

Referring now to FIG. 29 there is shown a diagram of one form of the logic of the present invention which will perform the necessary sequential steps of the operation of the ice maker or their equivalent through the cycle of operation required to make half crescent shaped ice pieces.

In FIG. 29 assume that a cycle of ice piece making has just been completed and the motor 103 has been turned off via block 317 and lead 315 at the end of the counterclockwise rotation of the shaft 106 assembly when the leading ejector element has returned to dead 0° position, indicating the completion of half crescent shaped ice making cycle, as indicated in block 308. Before reaching block 308 i.e. before ejector elements 114 reach dead "0° "position, the logic of block 304 will be activated. The water valve 313 will be opened via lead 312 to permit water to flow from water supply 313, through tube 314, open water valve 316, tube 318 and into the freezer tray 100.

When the water level in tray 100 reaches a level 118, the water level sensor 320, which can be a position of cam 39, will supply a signal via lead 322 to close water valve 316 and cause freezing of the water in tray 100 to begin by turning off heater 324 via lead 323.

Temperature sensor 326, which can be thermostat 326 of FIG. 1, detects when the water in tray 100 reaches a desired freezing temperature to freeze the ice pieces and will then supply a signal via leads 328, 342 and, AND gate 331 to turn on heater 324 so that it can be heated by power from power source 332 via lead 334, and AND gate 331 thereby releasing the ice pieces from the freezer tray 100 (FIG. 2), so that they can be ejected in the manner described in connection with FIGS. 8–24. The signal on lead 328 will also supply a signal via leads 328, 342, AND gate 331, 330, delay 340 (optional}and lead 341 to turn on motor 103 to enable the start of a new ice making cycle period. Energizing the motor 103 will begin rotation of shaft 106 and thereby begin the ejection of the crescent shaped ice pieces from tray 100 as half crescent shaped ice pieces.

It is to be understood that the forms of the invention shown and described herein are but preferred embodiments thereof and that various modifications and other forms of the invention can be made by one of ordinary skill in the art without departing from the spirit or scope of the invention as defined herein in the appended claims.

I claim:

1. In a half crescent shaped ice piece maker comprising an elongated tray having an arcuately shaped inner surface extending along the length of the tray about a radial line axis and divided into a plurality of full crescent shaped cavities arranged sideby-side in said tray, a bi-directional rotatable shaft having an axis of rotation coincident with said radial line axis, and leading and lagging rows of ejector elements, with each row of ejector elements lying in a separate plane with the first ends of the lagging row of ejector elements being securely attached to, but slightly off-center from the axis of said shaft and with the first ends of the leading row of ejector elements being securely attached to the side of one of the lagging ejector elements close to the axis of said shaft, and with the second ends of each leading ejector element extending downwardly into the center of a cavity at the beginning of an ice making cycle to divide said cavity into two half crescent shaped cavities which ultimately will form two half crescent shaped ice pieces;

control means for controlling the direction of rotation of said shaft the circumferential point during the rotation of said shaft at which a reversal of rotation of direction occurs and when and for what period of time the rotation of said shaft ceases;

a row of stripper elements positioned to pass between said ejector elements and to strip said half crescent ice pieces from said ejector elements as said ejector elements rotate between adjacent ones of said stripper elements;

said control means, at the end of each previous ice making cycle causing said leading row of ejector elements to rotate clockwise a predetermined angular amount past said stripper elements to first strip said leading half crescent ice pieces from said leading ejector elements and to then strip said lagging half crescent ice pieces from said leading ejector elements, and to then reverse the direction of rotation of said shaft to a counter-clockwise direction for a second angular distance less than said first angular distance during which the flow of water into the now empty crescent shaped cavities occurs;

said control means causing said shaft to continue to rotate in a counter-clockwise direction until the leading row of ejector elements becomes directed downward into the center of a cavity at which time the shaft rotation ceases and the water in the cavities is allowed to freeze; and said control means further comprising temperature sensing means responsive to the freezing of said water to cause said shaft to rotate in a clockwise direction said first angular distance to begin a new cycle of half crescent shaped ice piece making.

2. In a half crescent ice piece maker comprising an elongated tray having an arcuately shaped inner surface extending along the length of the tray about a radial line axis and divided into a plurality of full crescent shaped cavities arranged side-by-side along the length of said tray;

a controllably bi-directional rotatable shaft have an axis of rotation coincident with said radial line axis, leading and lagging rows of ejector elements lying in separate planes with a first end of each lagging ejector element being attached to one of said lagging ejector elements near or at the axis of said shaft and with said leading ejector elements extending downwardly into the center of said cavities herein defined as the dead zero degrees of rotation position with the second ends of said leading ejector elements being of a length to leave a spacing between the second end of said leading ejector elements and the bottom of said cavity in which an ice bridge can form between the leading and lagging ice pieces;

a row of stripper elements positioned to pass between said ejector elements and to strip said half crescent ice pieces from said ejector elements as said ejector elements rotate between adjacent ones of said stripper elements;

control means for controlling the direction of rotation of said shaft in a clockwise direction from said zero degrees rotation position for X angular degrees and past the stripper elements to strip said leading and lagging crescent shaped ice pieces from said ejector elements and to then reverse the direction of rotation of said shaft and ejector elements to a counter-clockwise direction for Y degrees of rotation, where $X^\circ > Y^\circ$;

said control means responsive to the end of said Y degrees of reverse rotation to initiate a predetermined level of water flow into said cavities in preparation for forming a new batch of half crescent shaped ice pieces but continues to rotate in said reverse direction to said dead zero degrees of rotation position of said leading ejector elements;

said control means responsive to said leading ejector elements being in said zero degrees rotation position to allow said leading ejector elements to remain there until the water in said cavities freezes; and said control means further responsive to freezing of said water in said cavities to begin rotation of said shaft in said clockwise direction to begin the production of a new batch of half crescent shaped ice pieces.

3. In a half crescent shaped ice piece maker as in claim 2 in which said control means comprises:

a cam means rotatable on an axis secured to, and in alignment with, the axis of said shaft and designed to actuate predetermined contacts as said shaft and cam means rotate in unison;

first stop means responsive to the clockwise rotation of said shaft X degrees after freezing of said half crescent ice pieces to stall and reverse the direction of rotation of said bidirectional motor, shaft, and cam through a counter-clockwise direction of rotation Y°;

first contact means responsive to the counter-clockwise rotation of said cam Y° to initiate water flow into said cavities to said predetermined level;

said shaft and cam continuing to rotate to said dead 0° rotation position; and second stop means positioned adjacent said cam means to stop the rotation of said cam means and said shaft to enable said leading ejector elements to be positioned downwardly into the center of said cavities and in their dead 0° portion of rotation position; and temperature sensing means for sensing when said water is frozen into leading and lagging half crescent shaped ice pieces to initiate rotation of said shaft and cam in a clockwise direction for X° of rotation to begin a new cycle of making crescent shaped ice pieces.

4. In a half crescent shaped ice piece maker as in claim 3 in which;

a first end of one of each of said leading and lagging ejector elements is attached near the same axial portion of said shaft but offset from the axis of said shaft by a predetermined amount and with said leading ejector elements having a width narrower than the distance between adjacent stripper elements but with the width of the half crescent shaped ice pieces frozen to said ejector elements being slightly greater than the distance between adjacent stripper elements.

5. In a half crescent shaped ice piece maker as in claim 3 in which said leading ejector elements are of a slightly spring, material, to enable said leading ejector elements to flex in a direction opposite the rotation of said shaft when said leading ice pieces first impact said stripper elements to facilitate the breaking of the ice bridge between the leading an lagging half crescent ice pieces to immediately thereafter enable the flexed-back leading ejector element to spring forward and impel the leading half crescent ice pieces along the surfaces of the stripper elements.

6. A method of forming half crescent shaped ice pieces in an elongated freezer tray having an arcuately shaped inner surface extending along its entire length with separators therein spaced apart from each other to form a series of crescent shaped cavities for receiving water and whose sides are normal to the longitudinal line axis of said elongated arcuately shaped tray, a bidirectionally rotatable shaft whose axis is coincident with said line axis of said elongated tray, leading and lagging rows of ejector elements each attached at a first end to said shaft and with said row of lagging ejector elements all lying in a first plane and with said row of leading ejector elements lying in a second plane and with the second ends of each of said leading ejectors of said leading row of ejector elements extending into a cavity in the freezer tray but leaving a gap between the second ends of said leading ejector elements and said bottom of said elongated tray to form an ice bridge between said leading and lagging ice pieces when the water is frozen in said cavities, and stripper means for stripping said crescent shaped ice pieces from said ejector elements when said shaft is rotated clockwise a predetermined amount, said method comprising the steps of:

freezing the water in said cavities when said leading ejector elements are at their dead 0° position extending downwardly from said shaft into the center of each of said cavities to divide said cavities and the water in them into a leading half crescent shaped cavity filled to a predetermined level with water and a lagging half crescent shaped cavity, filled with water to a predetermined level;

rotating said shaft clockwise a predetermined amount of X° and past said stripper elements to a first stop element to eject both said leading and said lagging crescent shaped ice pieces from said ejector elements;

controlling the stopping of said rotating shaft to reverse the rotation of said shaft for Y° of counterclockwise rotation, where $X° > Y°$;

initiating the flow of water into said leading and lagging cavities when said shaft has rotated counterclockwise Y°;

continuing the rotation of said shaft counterclockwise until it reaches its dead 0° position;

stopping the rotation of said shaft and said leading ejector elements in their dead 0° position;

filling said cavities with water to said predetermined level;

freezing said water in said cavities to form leading and lagging crescent shaped ice pieces;

rotating said shaft and ejector elements clockwise for X° to begin a new cycle of half crescent shaped ice pieces.

7. A method as in claim 6 comprising the further steps of:

forming the leading ejector elements of a spring-like material to enable said leading ejector elements to be flexed backward in a direction opposite the direction of rotation of said leading ejector elements when said leading crescent shaped ice pieces impact said stripper elements to break the ice bridge between the leading and lagging crescent shaped ice pieces; and allowing the flexed-back leading ejector elements to spring forward in the direction of the rotation of said leading ejector elements to impel the leading crescent shaped ice pieces along the to of the stripper elements towards and off the edge of said elongated tray.

8. A method as in claim 7 and further comprising the steps of:

forming a protuberance on that surface of each of said flexible, spring-like elements facing a lagging half crescent shaped ice piece;

freezing said protuberances in the surfaces of said lagging half crescent shaped ice pieces when said lagging crescent shaped ice pieces are frozen;

rotating said full crescent shaped in pieces until the leading row of half crescent shaped ice pieces impact the stripper elements and break and loose from said lagging row of half crescent shaped ice pieces;

preventing said lagging half crescent shaped ice pieces from moving away from the juncture of said protuberance and the point where said protuberance is frozen into the surface of the lagging half crescent shaped ice piece;

breaking loose said lagging half crescent shaped ice pieces from said protuberance when said leading flexible, spring-like ejector elements pass between adjacent ejector elements; and ejecting said broken-loose lagging half crescent shaped ice pieces from said tray by the continued rotation of a second row of ejector elements which follow said row of flexible, spring-like elements.

9. A method as in claim 6 and comprising the further steps of:

securing said leading ejector element to said shaft off center from the axis of said shaft when said shaft is viewed from a position after it has rotated clockwise about 270° from its dead 0° position; and securing said lagging ejector elements to said shaft off center from the axis of said shaft and below the axis of said shaft when said leading ejector element has rotated about 180° from its dead 0° position.

10. A method as in claim 6 comprising the further step of graduating the height of the stripper elements to enable the leading half crescent ice pieces frozen to the leading ejector elements to impact the stripper elements sequentially either singly or in small groups to distribute the total impact of the leading half crescent shaped ice pieces over an interval of time, although short, and thus lessen the risk of stalling the rotating motor.

11. A method of forming half crescent shaped ice pieces in an elongated freezer tray having an inner surface arcuately shaped about a line radial axis extending along the length of said tray with said tray divided into a plurality of crescent shaped cavities whose sides are normal to said line radial axis, and a reversible rotatable shaft assembly having an axis of rotation coincident with said line radial axis and having a leading and a lagging row of ejector elements attached thereto with each of ejector elements row lying in a separate plane and with first ends of each of said ejector elements being secured to said shaft to enable each of said leading an lagging ejector elements to sweep through one of said cavities when said shaft is rotated, and further with the second ends of said leading ejector elements being spaced from the inner surface of said tray a given distance when said leading ejector elements are at their dead 0° position when extending down into the center of a cavity to create an ice bridge in said cavity between said leading and lagging crescent shaped ice pieces when said water is frozen, and stripper elements of gradually diminishing height positioned in the path of said leading ejector elements but spaced apart a distance to enable the leading ejector elements to pass therethrough but not the crescent shaped ice pieces, said method comprising the steps of:

rotating said shaft clockwise X°, past said stripper elements to sequentially strip said crescent shaped ice pieces from said leading ejector elements;

reversing the rotation of said shaft to a counterclockwise direction for Y°, where X°>Y°;

initiating the flow of water into said cavities to a predetermined level;

continuing the counterclockwise rotation of said shaft until said leading ejector elements are positioned downwardly into the center of said cavities;

freezing the water in said cavities to form leading and lagging crescent shaped ice pieces;

rotating said shaft and said ejector elements in a clockwise direction X° to begin another cycle of half crescent shaped ice pieces.

12. A method as in claim 11 comprising the further steps of:

forming the leading ejector elements of a spring-like material to enable said leading ejector elements to be flexed backward in a direction opposite the direction of rotation of said leading ejector element when said leading crescent shaped ice pieces impact said stripper element to break the ice bridge between the leading and lagging crescent shaped ice pieces; and allowing the flexed-back leading ejector elements to spring forward in the direction of the rotation of said leading ejector elements to impel the leading crescent shaped ice pieces along the top of the stripper elements towards and off the edge of said elongated freezer tray.

13. A method as in claim 11 in which each of said flexible, spring-like ejector elements comprise a protuberance on the side thereof facing a lagging half crescent shaped ice piece to prevent said lagging half crescent shaped ice piece from sliding outwardly when said leading row of half crescent shaped ice pieces is moved outwardly on said flexible, spring-like ejector elements upon impact with said stripper elements, and further which prevents the lagging row of half crescent shaped ice pieces from sliding down said flexible, spring-like ejector elements after said leading row of half crescent shaped ice pieces has been broken loose from said lagging row of half crescent shaped ice pieces upon impact with said stripper elements.

14. A method as in claim 11 and comprising the further steps of:

securing said leading ejector element to said shaft off center from the axis of said shaft when said shaft is viewed normal to its axis after said shaft has rotated clockwise about 270° from its dead 0° position; and securing said lagging ejector element to said shaft off center from the axis of said shaft and below the axis of said shaft when said leading ejector element has rotated about 180° from its dead 0° position.

15. A method of forming half crescent shaped ice pieces in an elongated freezer tray having an inner surface arcuately shaped about a line radial axis extending along the length of said tray with said tray divided into a plurality of crescent shaped cavities whose sides are normal to said line radial axis, and a reversible rotatable shaft assembly having an axis of rotation coincident with said line radial axis and having a leading and a lagging row of ejector elements attached thereto with each row of ejector elements lying in a separate plane and with first ends of each of said ejector elements being secured to said shaft to enable each of said leading and lagging ejector elements to sweep through one of said cavities when said shaft is rotated, and further with the second ends of said leading ejector elements being spaced from the inner surface of said tray a given distance when said leading ejector elements are at their dead 0° position when extending down into the center of a cavity to create an ice bridge in said cavity between said leading and lagging crescent shaped ice pieces when said water is frozen, and stripper elements positioned in the path of said leading ejector elements but spaced apart a distance to enable the leading ejector elements to pass therethrough but not the crescent shaped ice pieces, said method comprising the steps of:

rotating said shaft clockwise X°, past said stripper elements to strip said crescent shaped ice pieces from said leading ejector elements;

reversing the rotation of said shaft to a counterclockwise direction for Y°, where X°>Y°;

initiating and continuing the flow of water into said cavities to a predetermined level in said cavities;

continuing the counterclockwise rotation of said shaft until said leading ejector elements are in their dead 0° position and positioned downwardly into the center of said cavities;

flowing water into said cavities;

freezing water in said cavities to form leading and lagging crescent shaped ice pieces;

rotating said shaft and said ejector elements in a clockwise direction X° to begin another cycle of making half crescent shaped ice pieces.

16. A method as in claim 15 comprising the further step of securing said leading ejector elements to said shaft off center from the axis of said shaft and above the axis of said shaft when said shaft has rotated clockwise 270° from its dead 0° position.

17. A method as in claim 15 comprising the further step of securing said lagging ejector element to said shaft off center from the axis of said shaft and below the axis of said shaft when said leading ejector element has rotated 180° from its dead 0° position and is viewed from a position normal to the axis of said shaft.

18. A method as in claim 15 comprising the further stop of graduating the height of the stripper elements to enable the leading half crescent ice pieces frozen to the leading ejector elements to impact the stripper elements sequentially either singly or in small groups to distribute the total impact of the leading half crescent shaped ice pieces over an interval of time, although short, and thus lessen the risk of stalling the rotating motor.

* * * * *